US005317985A

United States Patent [19]

Shewmon

[11] Patent Number: 5,317,985

[45] Date of Patent: Jun. 7, 1994

[54] SELF-OPENING BELT-LIKE DROGUES

[76] Inventor: Daniel C. Shewmon, 1940 Byram Rd., Clearwater, Fla. 34615-1508

[21] Appl. No.: 21,472

[22] Filed: Feb. 23, 1993

[51] Int. Cl.[5] ..... B63B 21/48

[52] U.S. Cl. ..... 114/311

[58] Field of Search ..... 114/294, 311; 244/138 R, 142, 145; 182/138, 139; 294/77

[56] References Cited

U.S. PATENT DOCUMENTS

| | | | |
|---|---|---|---|
| 378,171 | 2/1888 | McCarthy . | |
| 1,012,890 | 12/1911 | Miller . | |
| 2,454,853 | 11/1948 | Weinig | 244/145 |
| 2,494,600 | 1/1950 | Weinig | 244/145 |
| 2,651,481 | 9/1953 | Steinthal | 244/145 |
| 2,785,646 | 3/1957 | Meyer | 114/209 |
| 2,861,534 | 11/1958 | Fehlner | 114/209 |
| 3,011,820 | 12/1961 | Friedor et al. | 294/77 |
| 3,199,814 | 8/1965 | Frieder | 244/145 |
| 3,922,989 | 12/1975 | McEachern | 114/209 |
| 4,632,051 | 12/1986 | Raymond et al. | 114/311 |
| 4,778,131 | 10/1988 | Calianno | 244/145 |
| 5,062,379 | 11/1991 | Cherry | 114/311 |
| 5,108,326 | 4/1992 | Seiler | 441/22 |

FOREIGN PATENT DOCUMENTS 0258206 7/1988 Fed. Rep. of Germany .

OTHER PUBLICATIONS

From Ocean Navigator Issue No. 48 Jul./Aug. 1992 p. 4 lower left-hand corner of page "Gale Rider" Hathaway, Reiser & Raymond of 184 Sellect St., Stamford, Conn. 06902 (203) 324-9581 Write and Reference No. 123.

From National Maritime Institute of the United Kingdom 20636 "A stable sea anchor primarily intended for use with inflatable liferafts" shown at bottom of page.

*Primary Examiner*—Sherman Basinger

*Attorney, Agent, or Firm*—Dowell & Dowell

[57] ABSTRACT

Drogues are formed in a flat configuration having a central portion and peripheral edges consisting of a plurality of spaced inner and outer intersecting belts or webs which may be separately secured to one another at the points of intersection, or integrally formed, and wherein first supple reinforcements are secured rearwardly of the front surface of the belts along the peripheral edges and second supple reinforcements are secured to the belts extending from edge to edge generally centrally of the drogues so that the drogues automatically open when deployed and are pulled through water. In a preferred embodiment, the central portion of the drogues include a generally imperforate panel.

19 Claims, 3 Drawing Sheets

SELF-OPENING BELT-LIKE DROGUES

BACKGROUND OF THE INVENTION

This invention is generally directed to drogues and or sea anchors which are used as devices which are towed from the stern of water craft to act as a brake to reduce excessive and dangerous speed in conditions of high following winds and more specifically to drogues which are constructed so as to be compactly stored but which, when deployed, automatically assume an orientation which promotes the opening of the drogues as they are pulled through water. The invention more directly relates to open belted type drogues which are formed so as to create a plurality of open spaces between each of the belts through which fluid may pass and wherein the drogues act to control the speed of a vessel to thereby aid in stabilizing the vessel especially in rough seas.

FIELD OF THE INVENTION

For thousands of years ocean going vessels which are running before the wind have utilized turbulence making devices which are deployed off the stern of the vessel to act as partial brakes for reducing the speed of the vessel through the water. Although the terms "drogue" and "sea anchor" have been used interchangeably in the marine trade, the exact functioning of these devices differs. A sea anchor is generally a device deployed off the bow of a boat so as to function similarly to a metal ground anchor and is deployed for similar reasons but is used in water which is too deep for the practical use of a conventional anchor. On the other hand, a drogue is more properly defined as a device which is towed from the stern of a vessel to act as a brake to reduce excessive and dangerous speed in conditions of following winds. Although by definition, there are differences between drogues and sea anchors, for the purposes of this application the term drogue should be considered in its primary defined sense as set forth above but may also embody other structures more properly defined as sea anchors.

When drogues are deployed, they act as brakes to reduce the chances of the bow of a vessel being buried into the back side of a wave and then swerving uncontrollably sideways, heeling far over and down wind. This type of action is referred to in marine language as a "broach" and is a particularly dangerous situation for sailing vessels. It is possible in some conditions that following waves will actually roll broached vessels 90°–180° or more which can result in the sinking or destruction of a vessel. If the bow of a vessel buries itself while straight down wind, it is possible that the vessel's stern will be picked up by a large following wave. If this occurs the stern may be tossed over the bow thus upsetting the vessel and leaving it upside down. This type of action is referred to as "pitchpolling". The use of properly sized and deployed sea anchors usually precludes pitchpolling accidents and reduces dangerous broach situations. In some instances however, drogues can prevent broaching and pitchpolling by limiting the speed of the vessel. The use of drogues and sea anchors is not limited to large sailing vessels but also finds important use in stabilizing life rafts. Therefore, there is urgent need to provide drogue systems which are both cost effective and which function properly when deployed.

There are several operative characteristics which are very important in the deployment of a drogue. Initially, it is necessary that the drogue, when deployed, be open so as to provide the necessary resistance to reduce the vessel's speed. Secondarily, the drogue, when open, must be stable and not tumble due to wave action or the action of water passing therethrough. Tumbling of the anchor can result in misdirecting the vessel and also reduces the efficiency of the drogue to limit the vessel's speed.

Many conventional drogues function similar to parachutes in that they include canopies which have large openings which oppose fluid flow and which billow outwardly into either a conical or concave configuration against the action of fluid passing through the canopies. The canopies are connected to a plurality of bail lines which extend to a common tow line secured to a vessel. In some instances, drogue canopies are formed of perforated or open meshed fibers which permit fluid flow through the canopies. By varying the amount of open space through the canopy material, it is possible to alter the amount of force which the drogue develops along the bail lines and its effectiveness in controlling a vessel's speed. Unfortunately, most conical or semi-spherical drogue canopies do not function properly when deployed as the canopies do not automatically open against fluid flow. If the leading edge of the opening into the canopy is not forced outwardly by fluid flow, it is possible the edges will fold inwardly thereby either entirely collapsing the canopy or cause the tumbling effect which can result in hazardous situations and loss of proper speed control. In this respect, many conventional drogues use a reinforcing or stiffening wire frame around the opening into the canopy. The wire frame automatically retains the opening in an open circular configuration thereby assuring proper deployment of the drogue. Unfortunately, the use of such reinforced wire framing requires large storage areas to compensate for the metal framework and significantly increases the cost of the drogues making them less available especially for smaller crafts such as life rafts. Also, the handling of the wire framing or reinforcing presents a real safety hazard.

More recently, as opposed to utilizing open mesh or perforate fabric material, drogues have been formed utilizing open belting. U.S. Pat. No. 4,632,051 to Raymond, et al. discloses a sea anchor of a general conical configuration which is formed of a plurality of intersecting webs or belts which are secured at the open end of a canopy to an annular frame formed of a metallic ring or flexible cable which is fairly rigid so as to insure that the mouth of the canopy remains open in a circular configuration at all times. The sea anchor further includes a central imperforate portion at the apex of the conical structure for not only rigidifying the anchor but for increasing flow resistance when deployed. With this type of structure, the belting provides minimal resistance to fluid passage due to the conical configuration of the over all canopy and the webbing or belts function more specifically to connect the main frame at the mouth of the canopy to the imperforate central panel at the apex of the canopy. Unfortunately, the sea anchors disclosed in this patent are relatively expensive to manufacture and or difficult to store.

Other examples of generally semi-spherical or conical drogues or sea anchors are disclosed in U.S. Pat. Nos. 5,062,379 to Cherry and 5,108,326 to Seiler. Additional examples of more flat and imperforate structures for drogues or sea anchors are disclosed in U.S. Pat. Nos. 378,171 to McCarthy, 1,012,890 to Miller, 2,785,646 to Meyer, 2,861,534 to Fehlner, 4,778,131 to Callanno, 3,922,989 to McEachern and 4,612,870 to Shewmon.

In addition to the foregoing some examples of open belted type parachutes are disclosed in U.S. Pat. Nos. 2,454,853 and 2,494,600 to Weinig and German Patent 258206A1 dated Jul. 13, 1988.

A SUMMARY OF THE INVENTION

This invention is directed to drogues having flat body portions formed of inner and outer intersecting belts or webs which are spaced to create openings therebetween and which are either integrally formed with respect to one another or are secured such as by stitching at each point of intersection. The outer belts define the periphery of the body portion of the drogue and the body portion is defined having front and rear surfaces. Each of the outer belts is reinforced along the rear surface, or spaced from the front surface, by supple reinforcing elements which, in the preferred embodiment, includes two ropes which extend generally parallel with respect to one another and which are stitched to the outer belts or webs. In some embodiments the webs or belts may be folded over so as to enclose the ropes between the front and rear surfaces of the belts. Further, at least one, and preferably two, intersecting belts or webs which extend through the central portion of the drogue are reinforced along their rear surface, or spaced from the front surface, utilizing additional supple reinforcing elements. Again, in the preferred embodiment, the reinforcing elements are formed as a pair of ropes which are stitched to the centrally crossing webs and extend to the peripheral edges of the drogue.

The body portion of the drogue includes at least three, and preferably four outer belts which are joined at their ends to form corners wherein loops are formed extending outwardly of the body portion. Bail lines are secured to the loops and extend forwardly for purposes of securing the drogues to a vessel.

In a preferred embodiment the central area of the body portion of the drogue includes an imperforate panel.

To further increase the self-opening capability of the drogues of the present invention during initial deployment, when ropes are used as reinforcing elements they are normally stitched tightly to the web or belting material to thereby flatten the ropes with respect thereto. This causes the belting to gather slightly upon itself thereby further inducing the opening of the body portion when the drogue is deployed.

It is the primary object of the present invention to provide a low cost drogue which is not only capable of being compactly folded for storage when not in use but which, when deployed, exhibits a self-opening feature which insures that the drogue is properly expanded.

It is another object of the present invention to provide a low cost self-opening drogue which is manufactured from supple materials so that there is no danger of harm from expanding metal components and this is much safer to deploy.

It is a further object of the present invention to provide a self-opening drogue which is constructed in a flat configuration having a plurality of side edges which are connected by loops to bail lines such that when the bail lines exert a pull on the corners of the drogue, the body portion will billow to form a canopy wherein the webs or belts are retained in generally opposing relationship with regard to fluid flow through the drogue thereby preventing tumbling of the drogue.

It is a further object of the present invention to provide a self-opening flat drogue which is formed of all supple materials and wherein the reinforcing associated with the drogue causes the belting from which the drogue is formed to be disposed at substantial right angles to the flow of fluid through the drogue to thereby retain the drogue in a fully open position when deployed.

It is yet a further object of the present invention to provide a self-opening flat drogue which may be inexpensively constructed utilizing sheets of fabric material which are cut so as to create an open web-like body configuration thereby significantly decreasing production time and material costs.

DESCRIPTION OF THE PREFERRED EMBODIMENT

Figure 1:
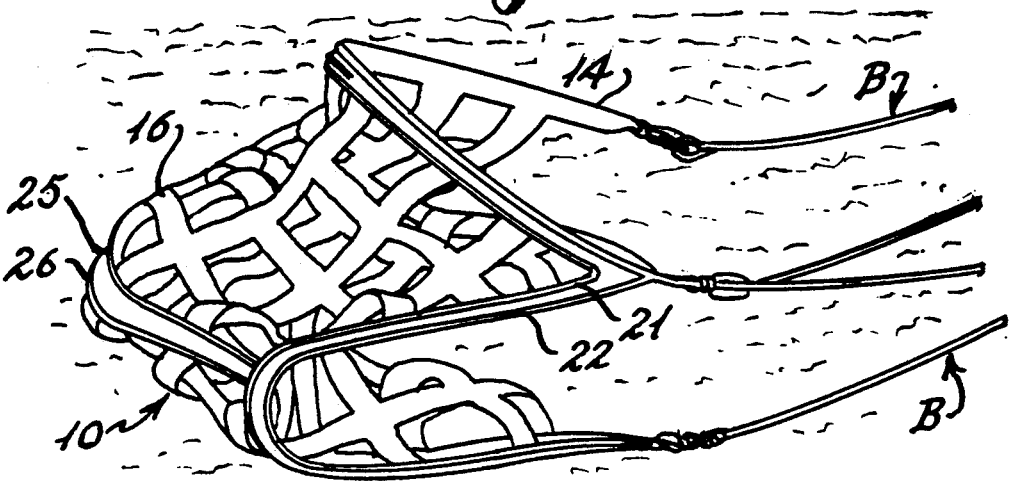
FIG. 1 is a perspective illustrational view of one embodiment of the present invention showing the drogue deployed without any force being exerted on the bail lines and showing the drogue in a self-opening position.
Figure 2:
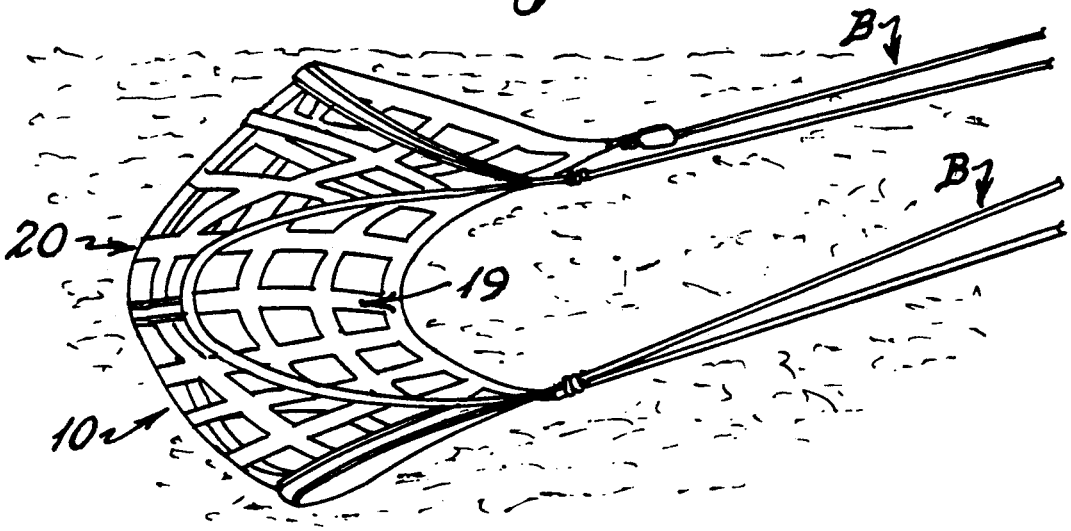
FIG. 2 is a perspective illustrational view of the drogue shown in FIG. 1 showing it open into a canopy configuration as force is exerted against the drogue tightening the bail lines.

With continued reference to the drawing figures, the drogues of the present invention are formed as generally flat belt-like or web configurations and several embodiments will be discussed with respect to the various drawing figures. Each of the drogues of the present invention is designed to be self-opening when deployed. That is, the drogues are designed so that when any force is exerted on the bail lines secured to each of the drogues, the drogues will open to provide maximum design resistance without collapsing or fluttering of the drogues in an open position. In this respect, FIG. 1 shows a drogue 10 in a deployed position wherein no stress has been placed on the bail lines B; that is, the drogue has simply been deposited overboard of a vessel and is in the water. It should be noted from the drawing figure that the upper portion of the drogue assumes a natural open position for reasons which will be discussed in greater detail hereinafter. In FIG. 2, once force has been placed upon the bail lines B, the drogue opens to a naturally bellowed canopy configuration wherein the belts associated with the drogue provided maximum resistance against the water. As previously discussed, one of the benefits of the present invention is that the drogues are designed to be formed of supple materials so that they are easily folded for convenient storage and yet exhibit a characteristic of being self-opening when deployed in a manner as disclosed in FIGS. 1 and 2.

Figure 3:
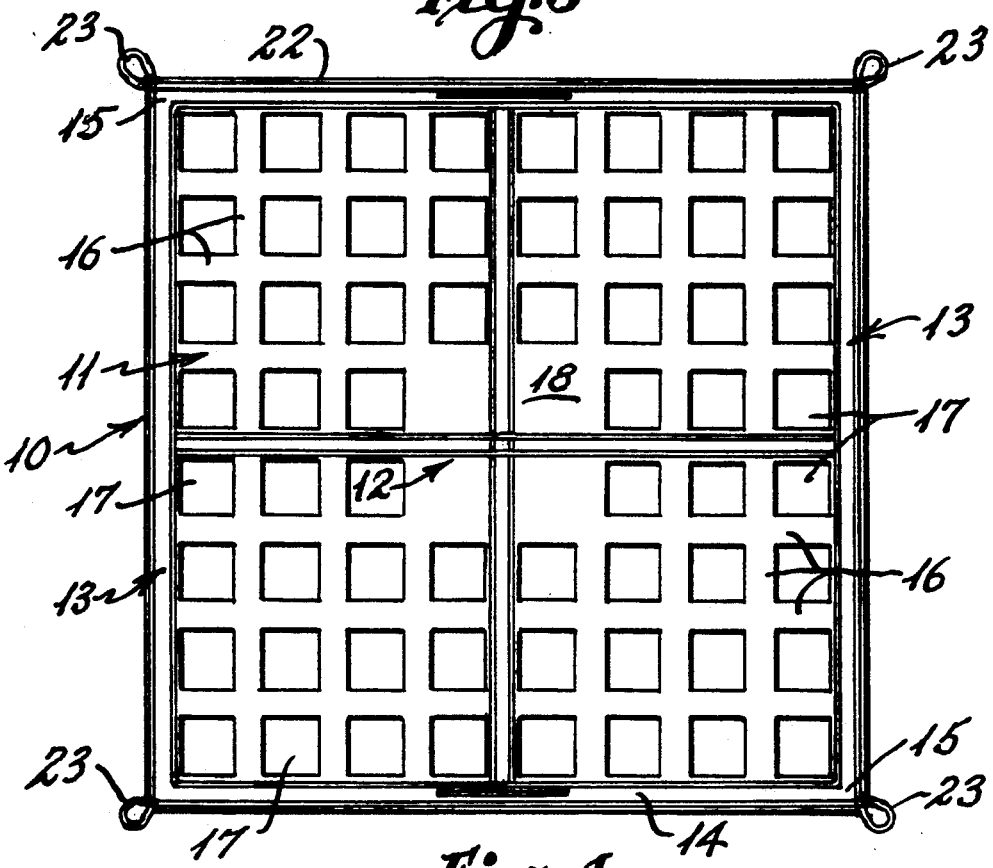
FIG. 3 is a rear plan view of the drogue shown in FIG. 1.

The drogue 10 shown in FIGS. 1 and 2 is shown in a bottom plan view in FIG. 3. The drogue includes a body portion 11 having a central portion 12 and peripheral portions 13. The peripheral portions are formed by a plurality of outer belts 14 which are integrally formed or connected together so as to form spaced corners 15. The body portion also includes a plurality of generally perpendicularly intersecting webs or belts 16 which are spaced from one another so as to provide openings 17 through the body portion of the drogue. In the embodiment shown in FIGS. 1-3, the central portion 12 includes an imperforate panel 18 which may either be separately secured to the body portion or integrally formed therewith. It should be noted that, in this embodiment, each of the webs or belts 14 and 16 may be integrally formed or cut from a common sheet of material. The material may vary, and in one test, a cloth was used having outer vinyl layers sandwiching a woven fiberglass layer. The material was 19 ounces per yard and 0.023 inch thick.

Each of the inner and outer belts 16 and 14 and therefore the body portion 11 of the drogue are defined by forward surfaces generally designated by 19 in FIGS. 1 and 2 and rear surfaces generally designated at 20 in FIGS. 1 and 2. The size of the openings 17 and the width of the belts 14 and 16 may vary from one drogue to another however test designs have incorporated 4 inch openings and 2 or 3 inch webs utilizing an overall body configuration of approximately feet by 4 feet. Utilizing these drogues the following test results were obtained exhibiting the resistance created by the drogues to pull on bail lines attached to a simulated vessel.

| SPEED, KN (knots) | PULL, LBS. (pounds) |
|---|---|
| 1 | 62 |
| 2 | 250 |
| 3 | 540 |
| 4 | 950 |
| 6 | 2100 |
| 7 | 2800 |
| 1) 48" SQUARE DROGUE WITH 2" SIMULATED WEBBING, 4 HOLES WERE NOT CUT OUT | |
| 1 | 93 |
| 2 | 360 |
| 3 | 800 |
| 4 | 1400 |
| 6 | 3000 |
| 7 | 4100 |
| 2) 48" SQUARE DROGUE WITH 3" SIMULATED WEBBING WITH 4 HOLES NOT CUT OUT | |

In order to reinforce each of the drogues of the present invention and to create the self-opening features of the invention, the flat body portions are reinforced along the peripheral belts 14. Further reinforcing may be applied to at least one of the inner belts 16 extending between the peripheral belts 14. In the embodiment shown in FIG. 3, reinforcement is provided along two (2) of the inner belts which intersect through the central portion 12 of the body of the drogue.

Although various reinforcing elements may be utilized, in the preferred embodiment ropes are extended along and are sewn into the webs or belts forming the body portion of the drogues. By way of example, and with reference to FIG. 3, the rear surface of the peripheral belts 14 are reinforced by inner and outer ropes 21 and 22 which are sewn to the webs or belts 14 adjacent the edges thereof. The outer rope 22 is looped as shown at 23 at each corner 15 so as to provide a way by which the bail lines B may be secured to the drogue 10. The ropes are secured to the webs or belt 14 by stitching. The ropes are sewn with enough thread tension to slightly pucker or indent the webbing and flatten the ropes relative thereto. As the ropes are tightly sewn and flattened, they become foreshortened, meaning that their length is decreased slightly. The ropes also act to gather the adjacent cloth or material from which the webs or belts are formed thereby creating a naturally slight bend or concavity of the webs or belts relative to the ropes toward the rear or trailing side of the body portion of the drogue. Because of this, the drogue is caused to open when deployed in the water without additional force being created. This configuration is shown in FIG. 1 of the drawings. With respect to FIG. 1, it is noted that in a deployed condition, the peripheral belts actually present themselves at generally right angles with respect to the direction of the bail lines therefore presenting their maximum width for assuring opening of the drogue to the configuration shown in FIG. 2 when pull is exerted along the bail lines B.

Figure 7:
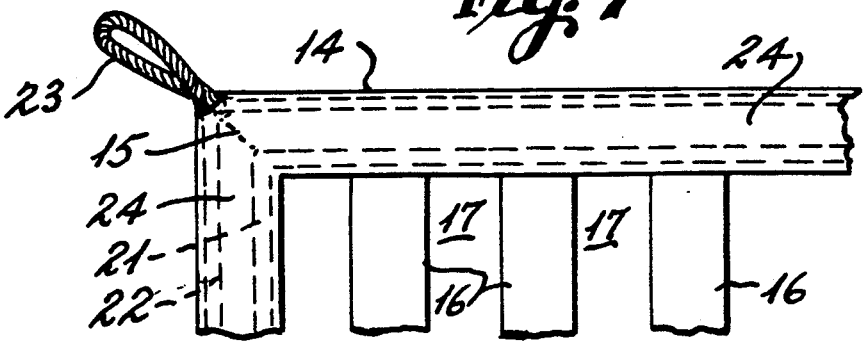
FIG. 7 is an enlarged partial rear plan view of a corner portion of an alternate embodiment of the drogue shown in FIG. 3.

To give further strength to the peripheral reinforcement, and in some embodiments and as shown in FIG. 7, the outer webs or belts may be formed of an extra width and folded over upon themselves rearwardly over the rear surface of the webs thereby enclosing or sandwiching the rope reinforcements therebetween. The rearwardly extending fold over portion is shown at 24 in the drawing figures. The fold over portion would thereafter be stitched to the front portion of the web and to each of the reinforcing inner and outer ropes 21 and 22. In some instances, as opposed to using the ropes 21 and 22, other supple reinforcing elements can be utilized. Such supple reinforcing elements may be multiply strands of cording or additional thickness of webbing material sufficient to create the self-opening features discussed above. For instance, additional webbing material may be utilized and folded over so as to create a rope like configuration which is thereafter sewn or secured to the peripheral webs. It is important that each reinforcing element be supple so as to allow the drogues to be folded into a compact flat configuration for storage.

With continued reference to FIG. 3, to further reinforce the central portion 12 of the drogue 10 relative to the outer peripheral portions, a first pair of reinforcing ropes 25 and 26 are shown as extending across a central web or belt 16 from the inner peripheral ropes 21 and through the center of the body portion. These ropes are sewn to the webs in the manner as described above with regard to the peripheral ropes 21 and 22. Further, in the embodiment shown, a second perpendicular set of reinforcing ropes 27 and 28 are disposed from the opposite edges of the drogue and through the center 12. These ropes are also sewn to the inner ropes 21 and are stitched to the belts 16 in the manner set forth above.

By utilizing the center reinforcing ropes in combination with the peripheral reinforcing ropes the ropes act as a frame which actually pushes the body portion 11 of the drogue through the water. Further, the inner ropes 25, 26, 27 and 28 also reinforce the central panel 12 which develops a great deal of the pulling load of the drogue due to the fact that the central panel is generally imperforate. In this respect, the size of the central panel may be varied to adjust the amount of force or pull which is established by the drogue when deployed.

As with the outer peripheral ropes 21 and 22, the inner sets of ropes 25, 26, 27 and 28 may be formed of a different material again exhibiting the supple characteristics of the ropes used in the preferred embodiment. By way of example, the 4 by 4 drogues discussed above in which the test results were given utilized 5/16 inch braided polyester (Dacron) rope as the reinforcing ropes of the inner and peripheral reinforcements.

It is important to note that the peripheral reinforcing and inner ropes are secured to the rear surface of the web or belt materials 14 and 16. This is to insure that the webs or belts are presented in the self-opening position shown in FIG. 1 and to further push the body portion of the drogue through the water as previously discussed. If the ropes are secured to the inner portion or surface of the body along the peripheral edges, the ropes themselves will tend to turn the belts 14 with their back sides somewhat toward the bails. This could result in the peripheral belts collapsing inwardly when force is exerted against the belts as tension is placed on the bail lines B thus preventing the opening of the drogues into the open configuration shown in FIG. 2 or possibly causing fluttering of the drogue prior to complete opening.

Figure 4:
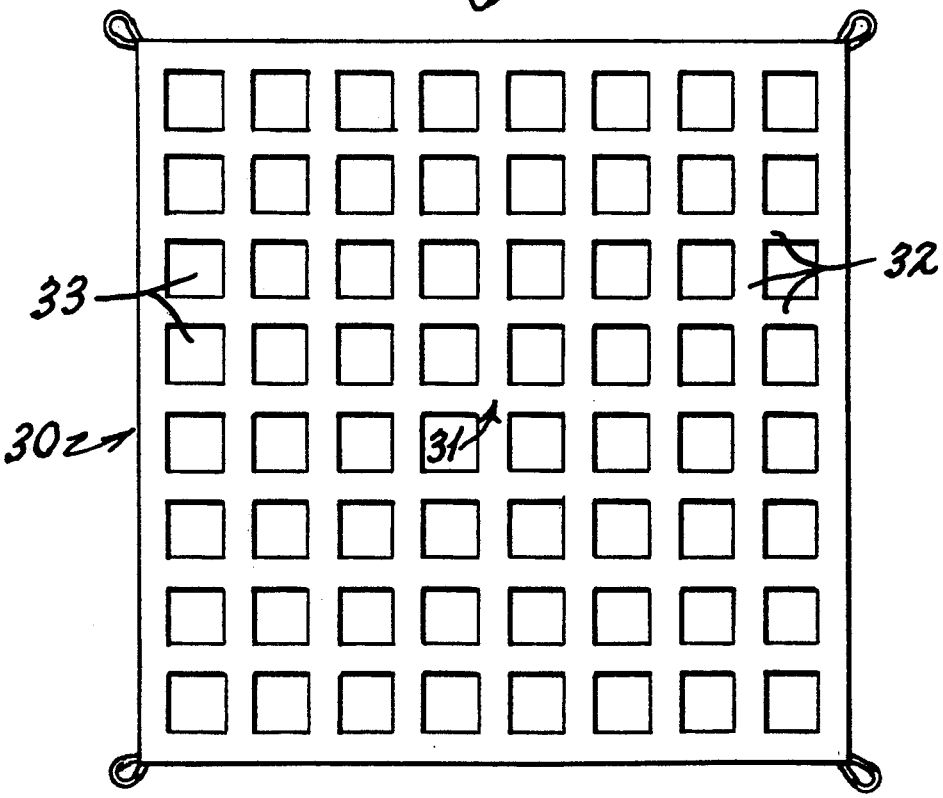
FIG. 4 is a front plan view of an alternate embodiment of the present invention.

A alternate embodiment of the present invention is shown in FIG. 4. In this embodiment, the drogue 30 is similar to that of the drogue of FIG. 3 in that it is formed of a continuous sheet of cloth material. As with the previous embodiment the type of material may vary without taking away from the teachings of the present invention. In this embodiment, however, the central portion of the drogue as shown at 31 does not include an imperforate panel such as shown at 12 in the embodiment of FIG. 3. In the embodiment of FIG. 4 the body portion is continuously formed of alternating intersecting inner belts or webs 32 which are spaced from one another so as to provide a plurality of generally regularly spaced openings 33 therebetween.

One of the benefits of forming the body portions of the embodiments shown in FIGS. 3 and 4 of a continuation sheet of material is that it allows a plurality of layers of material to be cut at a single time thereby reducing production cost significantly. In the past, availability of drogues has been somewhat limited by cost. As drogues can provide a valuable safety device for many marine vessels, it is believed that the more cost effective the drogues become, the more individuals will make use of such safety devices.

Figure 5:
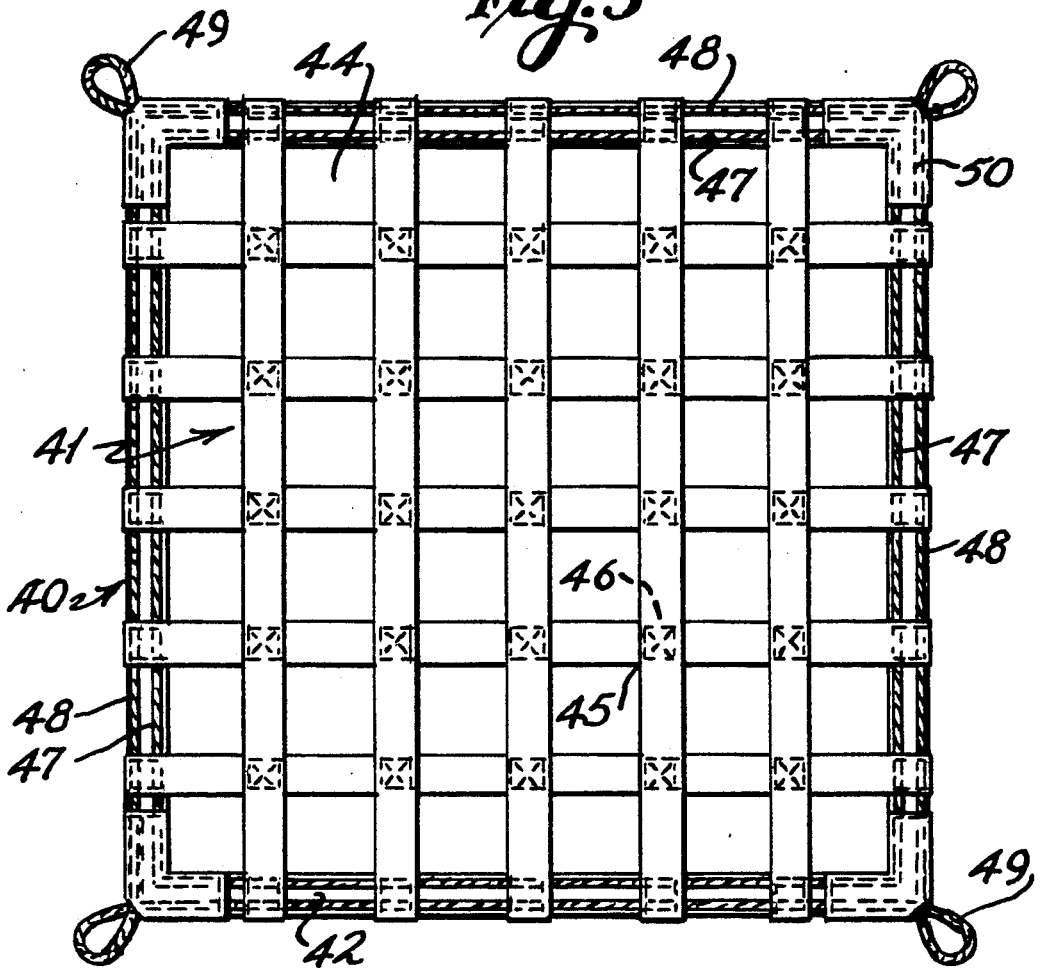
FIG. 5 is a front rear plan view of an second alternate embodiment of the present invention.
Figure 6:
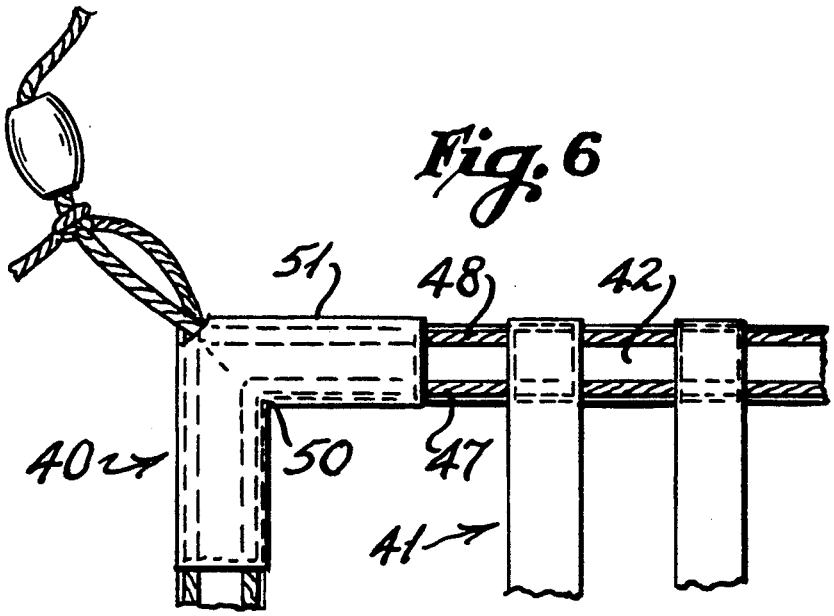
FIG. 6 is an enlarged partial rear plan view of the corner portion of the embodiment shown in FIG. 5 showing an overlap seamed construction along portions of the outer web or belt of the drogue.

Another embodiment of the present invention is shown in FIGS. 5 and 6. In this embodiment, the drogue 40 includes a body portion 41 defined by outer belts or webs 42 and intersecting inner belts 43. As with the previous embodiments, the inner belts 43 are spaced from one another creating open spaces 44. Although this embodiment does not show any central imperforate panel such as that shown at 12 of the embodiment in FIG. 3, it is possible that such a central imperforate panel may be utilized with this embodiment.

Unlike the previous embodiments, however, in this embodiment the webs or belts are formed of separate materials and may be formed of available belting material such as a two inch belt webbing of 0.042 inch thickness weighing approximately 35 ounces per yard. In this embodiment each of the belts must be secured to one another at each intersection 45 such as by cross-stitching shown at 46. Further, although the intersecting belts are showing as overlying each other, the belts may be interwoven to add further rigidity to the overall structure.

In this embodiment a pair of peripheral reinforcing elements, such as ropes 47 and 48, are extended along each of the outer belts 42 and are secured thereto such as by appropriate stitching in a manner as set forth above with respect to the previous embodiments. Again, it is important that the ropes be sewn to the rear portion of the belts, as is shown in FIG. 5, which is a rear view of the drogue. The outer ropes 48 are formed to create loops 49 at each of the corners 50 of the drogue. In this embodiment, further reinforcing is provided by an additional layer of belting at each of the corners as is shown at 51 with such belting being sewn to the inner and outer ropes 47 and 48.

In FIG. 5, no inner reinforcements are shown. It should be noted that, in some instances, the inner reinforcing elements or ropes may be utilized as shown in the embodiment of FIG. 3.

In each of the embodiments of the present invention, the drogues are formed as generally flat panels having body portions which are designed to have a front presenting and rear presenting surface. Because each of the elements of the drogues are formed of supple foldable materials, the drogues may be folded upon themselves and easily placed into compact storage areas. The drogues are designed to be secured to appropriate bail lines which are normally provided with the drogue. The bail lines may be connected by any appropriate means to the loops associated with each drogue. In the embodiments shown, four bail lines are needed for each drogue. It should be noted that the concepts of the present invention may also be utilized with other multi-sided configurations and therefore three, four or more sides for the drogues may be utilized within the teachings of the present invention.

As previously discussed, it is also an important feature of the drogues of the present invention that when they are removed from storage and deployed, that they automatically configure themselves so as to enable opening upon the slightest application of tension to the bail lines. Due to the rope reinforcement along the back or rear surfaces of the drogues, as shown in FIG. 1, the drogues will tend to fold open along the peripheral edges and also present the edge belts at generally right angles to the direction in which the drogues are to be pulled. Thus, once tension is placed upon the bails, the drogues will open fully as shown in FIG. 2 without fluttering and without collapsing inwardly of themselves.

I claim:

1. A drogue which is pulled by bail lines in a direction through the water, the drogue comprising, a relatively flat body portion having front and rear surfaces and a center portion, said body portion including a plurality of intersecting inner and outer belt means which are spaced so as to define a plurality of horizontally and vertically spaced openings therebetween substantially throughout said body portion, said outer belt means defining peripheral edges of said body portion, peripheral reinforcing means secured along the length of said peripheral edges and spaced from said front surface of said body portion, said peripheral reinforcing means being supple, means for securing said peripheral reinforcing means to said peripheral edges so as to configure said peripheral edges slightly concavely toward said peripheral reinforcing means so that said peripheral edges are positioned at an angle relative to a direction at which the drogue is to be pulled by the bail lines when the drogue is deployed in the water to thereby facilitate opening of the drogue, and a plurality of bail attaching means secured in spaced relationship to said peripheral reinforcing means.

2. The drogue of claim 1 including at least one central reinforcing means secured to and along the length of at least one of said inner belt means and extending through said center portion and to said peripheral edges of said body portion, said central reinforcing means being supple and being secured in spaced relationship relative to said front surface of said body portion.

3. The drogue of claim 2 in which said body portion includes at least three outer belt means which are connected in end to end relationship to form spaced corners, and said bail attaching means including loops being formed at said corners.

4. The drogue of claim 2 in which said body portion includes four outer belt means which are connected in end to end relationship to form spaced corners, and said bail attaching means including loops being formed at said corners.

5. The drogue of claim 2 including at least one pair of central reinforcing means extending along and secured to a pair of intersecting inner belt means which extend through said center portion of said body portion.

6. The drogue of claim 5 in which said inner and outer belt means are integrally formed with one another.

7. The drogue of claim 6 in which said body portion includes a substantially imperforate panel means centrally of said center portion thereof, said panel means being surrounded by said spaced openings.

8. The drogue of claim 5 in which said peripheral and central reinforcing means are rope means, and stitching securing said rope means to said outer and inner belt means.

9. The drogue of claim 8 in which each of said rope means includes a pair of ropes extending generally parallel with respect to one another.

10. The drogue of claim 9 in which said stitching securing said ropes substantially flatten said ropes to thereby pucker said outer and inner belt means adjacent said ropes.

11. The drogue of claim 10 in which said inner and outer belt means are integrally formed with one another.

12. The drogue of claim 11 in which said outer belt means are folded over said ropes and said stitching extending through the folded over portion of said outer belt means and said ropes.

13. The drogue of claim 11 in which said body portion includes a substantially imperforate panel means centrally of said center portion thereof, said panel means being surrounded by said spaced openings.

14. The drogue of claim 1 in which said body portion includes a substantially imperforate panel means centrally of said center portion thereof, said panel means being surrounded by said spaced openings.

15. The drogue of claim 1 including a plurality of separate interwoven belts forming said intersecting inner and outer belt means, and means for securing said plurality of belts at each point of intersection therebetween.

16. The drogue of claim 15 including at least one central reinforcing means secured to and extending along the length of at least one of said inner belt means and extending through said center portion to said peripheral edges of said body portion, said central reinforcing means being supple and being secured in spaced relationship relative to said front surface of said body portion.

17. The drogue of claim 16 including at least one pair of central reinforcing means extending along and secured to a pair of intersecting inner belt means which extend centrally through said center portion of said body portion.

18. The drogue of claim 17 in which said peripheral and central reinforcing means are ropes, and stitching securing said ropes to said outer and inner belt means.

19. The drogue of claim 18 including an imperforate panel member centrally of said center portion of said body portion.

* * * * *